US006041692A

United States Patent [19]

Grosspietsch et al.

[11] Patent Number: 6,041,692

[45] Date of Patent: Mar. 28, 2000

[54] OPERATION OF PRESSURE MEDIUM CYLINDERS IN MOTOR VEHICLES

[75] Inventors: Wolfgang Grosspietsch; Angelika Ebert, both of Schweinfurt, Germany

[73] Assignee: Mannesmann Sachs AG, Schweinfurt, Germany

[21] Appl. No.: 09/023,619

[22] Filed: Feb. 13, 1998

[30] Foreign Application Priority Data

Feb. 28, 1997 [DE] Germany ..... 197 08 039

[51] Int. Cl.[7] ..... F01B 15/04

[52] U.S. Cl. ..... 92/118; 92/128; 92/161

[58] Field of Search ..... 92/118, 119, 128, 92/146, 161

[56] References Cited

U.S. PATENT DOCUMENTS

| | | | |
|---|---|---|---|
| 1,457,156 | 5/1923 | Frock | 92/118 |
| 3,179,017 | 4/1965 | Bunker | 92/118 |
| 3,304,839 | 2/1967 | Van House et al. | 92/118 |
| 5,090,201 | 2/1992 | Smith | 92/118 |
| 5,476,162 | 12/1995 | Reed et al. | 92/161 |

FOREIGN PATENT DOCUMENTS 0 229 350 B1 3/1991 European Pat. Off. .

*Primary Examiner*—Thomas E. Denion

*Attorney, Agent, or Firm*—Cohen, Potani, Lieberman & Pavane

[57] ABSTRACT

Disclosed is a pressure medium cylinder, especially a hydraulic input cylinder, located on the chassis of a motor vehicle and operated by means of a pedal, whereby the tappet for operating the piston in the cylinder housing can be attached to different lever lengths, so that different requirements for the power/displacement ratio can be met with one and the same input cylinder. It is advantageous that the same components are used, in particular, a changeably-mounted joint head that produces different lever lengths for the attachment of the articulated part in the pedal arm.

12 Claims, 2 Drawing Sheets

OPERATION OF PRESSURE MEDIUM CYLINDERS IN MOTOR VEHICLES

BACKGROUND OF THE INVENTION

The invention relates to a pressure medium cylinder, especially a hydraulic input cylinder of the type which can be attached to the chassis of a motor vehicle.

All hydraulically-operated aggregates in motor vehicles are associated, in the layout of the input and output cylinders that operate these aggregates, with certain dimensions that are optimal for the power/displacement ratios. Specifically, it is piston displacement and piston diameter that permit certain operating forces to be transmitted at certain operating displacements.

EP 0 229 350 B1 discloses an operating device having an articulated connection which includes an insertable plastic part, which can be clipped into the pedal and has a ball socket to hold an articulated part. Such a connection greatly simplifies assembly, but is designed for only a single output device, and thus cannot respond to the different requirements for power/displacement ratios in one and the same vehicle type with identical installation conditions for the input-output cylinders.

Depending on the purpose for which they are used, however, vehicles of one and the same type are known to use output devices with very different preloads. Previously, this has required the installation of different types of input-output cylinders. The various sizes of these cylinders and their associated pistons significantly reduce the number of input-output cylinders of one size produced in any single series and accordingly increases the manufacturing costs of the input-output cylinders for one and the same motor vehicle type, even though a sufficient number of such vehicles exist for the rational production of components. The range of power/displacement ratios in one motor vehicle type could generally be covered with two sizes of input-output cylinder. It is therefore proposed to attach the input cylinder to two positions on the pedal, i.e., with different lever lengths, by the articulated part of its tappet.

Such a solution represents a compromise, insofar as the operating displacement of the piston increases along with the lever length. Consistent with the laws of physics regarding levers, the power increases, as desired, as the lever length is reduced. Thus, a design is needed that provides a sufficiently large operating displacement for each of the planned positions. If the operating displacement in the shorter-length position of the articulated part on the pedal is sufficient, then it is only necessary to ensure that the operating displacement in the longer-length position of the articulated part on the pedal is not too great, since this may cause damage to the hydraulic system. In this case, a mechanical stop is needed. The stop can be located on the holding piece with which the input cylinder is arranged on the motor vehicle chassis.

The object of the invention is therefore to provide an input cylinder which, due to the variable connection to the pedal of an articulated part of a tappet for operating a piston of the input cylinder, meets, while using the same attachment parts, different requirements for the power/displacement ratios of the hydraulic operating unit in the motor vehicle.

SUMMARY OF THE INVENTION

The object of the invention is obtained by a pressure medium cylinder, especially a hydraulic input cylinder, for attachment to the chassis of motor vehicles. The cylinder has a piston and a tappet for operating the piston in the cylinder. The tappet has an outer end as an articulated part, which is connected in an articulated fashion to the vehicle pedal. The pedal has a pedal arm and a joint head and the articulated part can be mounted in multiple positions in the joint head with at least two lever lengths relative to the rotational point of the pedal.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF THE PREFERRED EMBODIMENT

Figure 1:
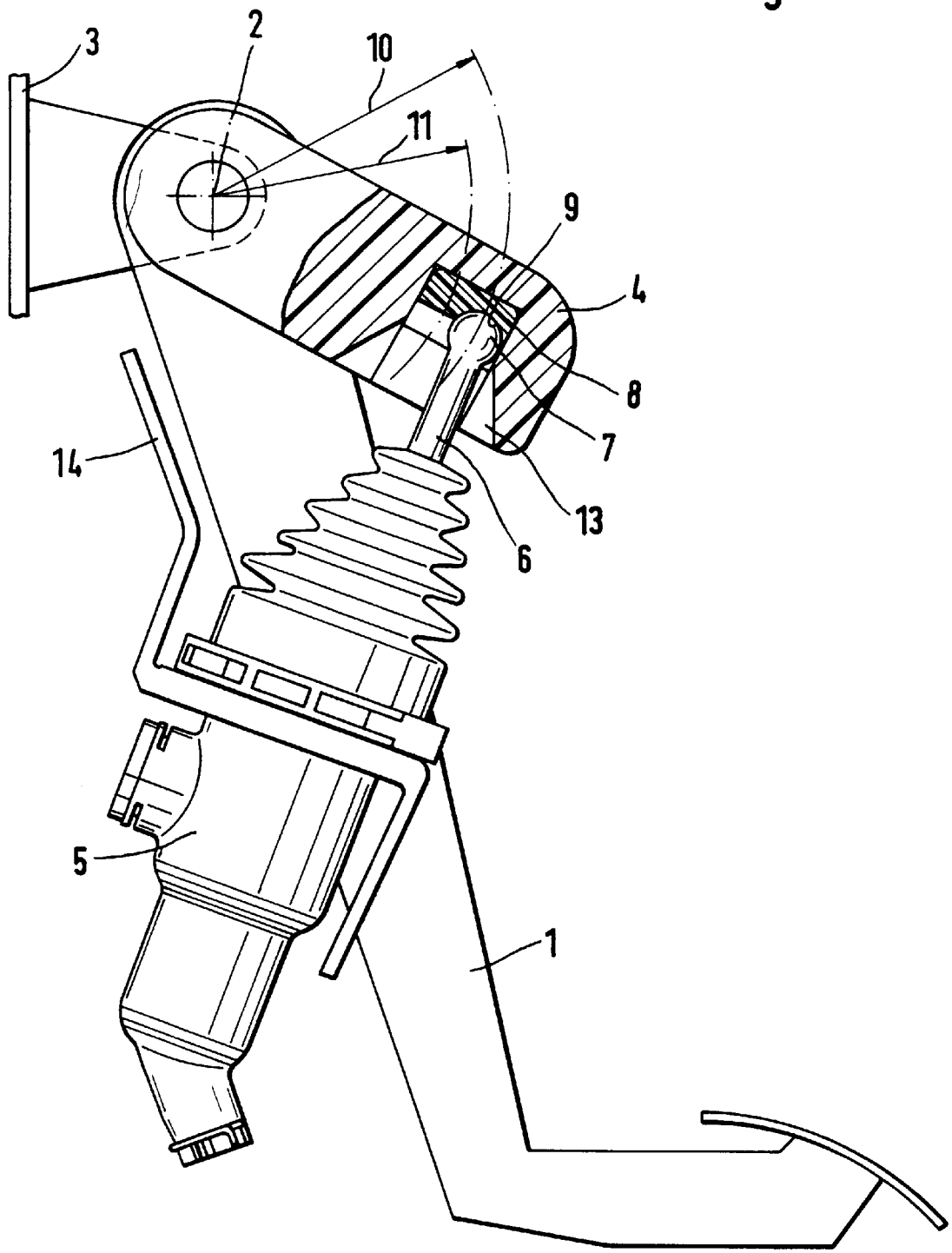
FIG. 1 shows the invention wherein an input cylinder is connected to a pedal via an articulated part of a tappet to a pedal lever.

Referring to FIG. 1, a pedal 1 for operating a hydraulic system has a rotational point 2 which is the center point of a bearing by means of which the pedal 1 is rotatably arranged on a chassis 3 of a motor vehicle. Also arranged on the chassis 3 is a holding piece 14, which secures a cylinder housing 5 of an input cylinder. The piston located in the interior of the cylinder housing 5 is operated by means of a tappet 6, whose end is embodied as an articulated part 7 that is connected to the pivotable pedal 1 via a pedal arm 4. The articulated part 7 is connected to the pedal arm 4 via a joint head 8, which is detachably connected to the pedal arm 4. The joint head 8 has at least one mounting socket 9, which is embodied asymmetrically, relative to the shape of the joint head 8, in the form of a ball socket, since the articulated part 7 preferably also has a ball shape.

Figure 3:
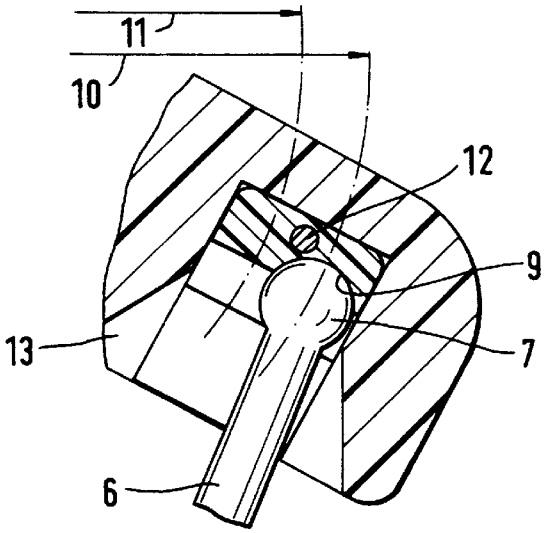
FIG. 3 shows an arrangement of the articulated part in the joint head with a first lever length.

As illustrated in FIGS. 1 and 3, the articulated part 7 is connected to the pedal arm 4 via the joint head 8 by fitting the articulated part 7 into the mounting socket 9. This arrangement establishes a first lever length 10 relative to the center of the articulated part 7 or mounting socket 9 and to the rotational point 2 of the pedal 1 or pedal arm 4. The first lever length 10 produces an exact relationship between the piston displacement of the piston in the cylinder housing 5 and the pedal displacement of the pedal 1.

Figure 4:
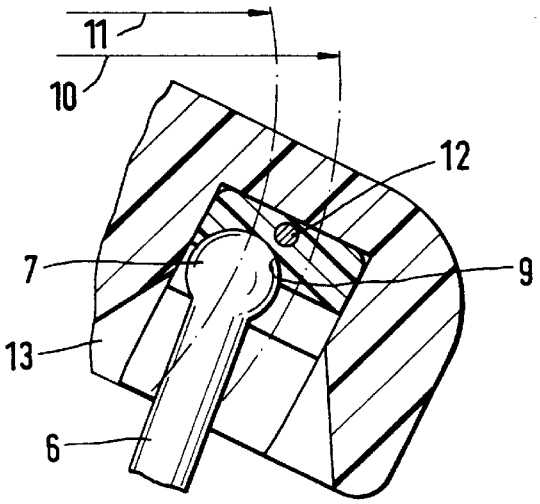
FIG. 4 shows an arrangement of the articulated part in the joint head with a second lever length.

If it is found that lower pedal forces are required to operate the piston in the cylinder housing 5, a second, shorter lever length 11 can be implemented, as shown in FIG. 4, by mounting the joint head 8 in the pedal arm 4 in a changeable fashion. The distance from the center of the articulated part 7 to the rotational point 2 then corresponds to the second lever length 11, upon which the piston displacements in the cylinder housing 5 are reduced proportionately, while the operating forces increase at the same ratio.

The connection of the tappet 6 to the piston in the cylinder housing 5 must also be an articulated one, because pendulum motions of the tappet 6 result from the fact that the center of the articulated part 7 turns on the radius of the first lever length 10 or the second lever length 11, so that the tappet 6 moves back and forth on a certain pivot plane during operation.

Figure 2:
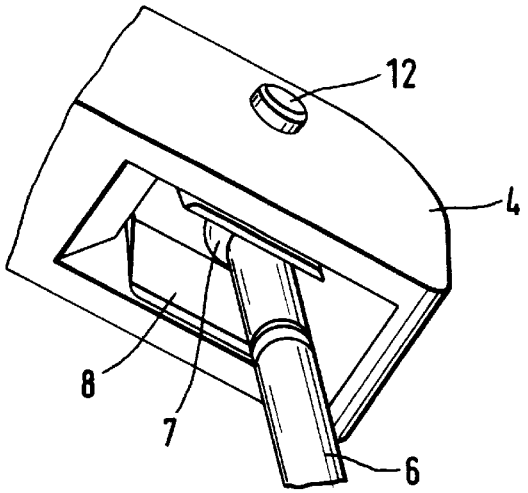
FIG. 2 shows a connection of the articulated part to the pedal lever via a joint head.

FIG. 2 shows how the joint head 8 is connected to the pedal arm 4, specifically, by means of an attachment element 12 that holds the joint head 8, which is inserted in a recess 13 in the pedal arm 4. The attachment element 12 can be embodied as a screw or a pin. In FIGS. 3 and 4, the attachment element 12 is arranged symmetrically in the joint head 8, so that the joint head 8 can be mounted in a changeable fashion. In a first position, shown in FIG. 3, the center of the articulated part 7 is located on the radius of the first, longer lever length 10. As a result, greater displacements are possible in the hydraulic system.

In FIG. 4, the center of the articulated part 7 is located on the smaller radius of the second lever length 11. This comes about by the changeable mounting of the joint head 8 in the pedal arm 4, since the attachment element 12 is arranged symmetrically relative to the joint head 8 and can remain in the same position.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

We claim:

1. A pressure medium cylinder for attachment to a chassis of a motor vehicle comprising:

a cylinder having a piston; and a single tappet for operating the piston in the cylinder, said tappet having an outer articulated end part, said articulated end being connected in an articulated fashion to a pedal, said pedal having a rotational point and having a pedal arm and a single joint head for receiving said tappet, the articulated part being adapted for mounting in multiple positions in the single joint head with at least two lever lengths relative to the rotational point of the pedal.

2. The pressure medium cylinder of claim 1 wherein the joint head has multiple mounting sockets in which the articulated part can be mounted in a pivotable fashion.

3. The pressure medium cylinder of claim 1 wherein the joint head can be connected to the pedal arm in at least two positions.

4. The pressure medium cylinder of claim 1 wherein at least one mounting socket is arranged on the joint head asymmetrically, as a result of which, because of the changeable mounting of the joint head on the pedal arm, at least two positions of the articulated part with a first lever length and a second lever length relative to the rotational point of the pedal are created.

5. The pressure medium cylinder of claim 1 wherein the joint head is connected to the pedal arm by means of a symmetrically arranged attachment element that permits the changeable mounting of the joint head.

6. The pressure medium cylinder of claim 1 wherein the cylinder is a hydraulic input cylinder.

7. The pressure medium cylinder of claim 6, wherein the joint head has multiple mounting sockets in which the articulated part can be mounted in a pivotable fashion.

8. The pressure medium cylinder of claim 6, wherein the joint head can be connected to the pedal arm in at least two positions.

9. The pressure medium cylinder of claim 6, wherein at least one mounting socket is arranged on the joint head asymmetrically, as a result of which, because of the changeable mounting of the joint head on the pedal arm, at least two positions of the articulated part with a first lever length and a second lever length relative to the rotational point of the pedal are created.

10. The pressure medium cylinder of claim 6, wherein the joint head is connected to the pedal arm by a symmetrically arranged attachment element that permits the changeable mounting of the joint head.

11. An assembly comprising:

a pressure medium cylinder having a cylinder and a piston;

a single tappet, said tappet having a first and a second end, the first end operatively connected to said piston and the second end being articulated for a multiple position engagement; and a pedal, the pedal having a rotational point, an arm and a single joint head to receive said tappet wherein said joint head has a multiple position mounting socket and said second end of the tappet is adapted to be mounted in any of the mounting socket multiple positions so as to form levers of different lengths relative to the pedal rotational point.

12. A pressure medium cylinder for attachment to a chassis of a motor vehicle comprising:

a cylinder having a piston; and a single tappet for operating the piston in the cylinder, said tappet having an outer articulated end part, said articulated end being connected in an articulated fashion to a pedal, said pedal having a pedal arm and a single joint head for receiving said tappet, the articulated part being adapted for mounting in multiple positions in the single joint head with at least two lever lengths relative to the rotational point of the pedal wherein at least one mounting socket is arranged on the joint head asymmetrically, as a result of which, because of the changeable mounting of the joint head on the pedal arm, at least two positions of the articulated part with a first lever length and a second lever length relative to the rotational point of the pedal are created.

* * * * *